US005996951A

United States Patent [19]

O'Burill et al.

[11] Patent Number: 5,996,951

[45] Date of Patent: Dec. 7, 1999

[54] MOUNTING DEVICE FOR A DRYING RACK

[76] Inventors: Alain O'Burill, 2, rue du Lavoir, Saint Germain Au Mont d'Or; Ginés Canovas, Le Bourg, Amberieux d'Azergues, both of France

[21] Appl. No.: 09/213,356

[22] Filed: Dec. 17, 1998

[51] Int. Cl.[6] ..... A45D 42/14; A47G 29/00

[52] U.S. Cl. ..... 248/205.8; 248/205.5; 248/205.6; 248/206.1; 248/206.2; 248/683

[58] Field of Search ..... 248/205.8, 205.5, 248/205.6, 206.1, 206.2, 683, 363, 219.2, 121, 290.1, 308, 467

[56] References Cited

U.S. PATENT DOCUMENTS

| | | | |
|---|---|---|---|
| 1,278,790 | 9/1918 | Thunell | 312/324 |
| 1,374,609 | 4/1921 | Schell | 248/353 |
| 3,020,017 | 2/1962 | Watson | 248/205.8 |
| 4,712,692 | 12/1987 | Peinsipp . | |
| 5,630,291 | 5/1997 | Fontana | 47/41.01 |
| 5,865,325 | 2/1999 | Comstock | 211/181.1 |

FOREIGN PATENT DOCUMENTS 626 934 12/1981 Germany .

*Primary Examiner*—Derek J. Berger
*Assistant Examiner*—David Heisey
*Attorney, Agent, or Firm*—Oliff & Berridge, PLC

[57] ABSTRACT

A device designed to cooperate with the hanging hooks of a drying rack includes a levered suction cup whose body, in the shape of a circular dome, has an extension parallel to one diameter and a plane end face substantially perpendicular to the surface against which the suction cup is applied. The device further includes a transverse, rectilinear mounting bar with a plane central supporting surface that abuts the end face of the extension of the body and a mounting structure for attaching the bar to the extension of the suction cup body.

12 Claims, 3 Drawing Sheets

MOUNTING DEVICE FOR A DRYING RACK

BACKGROUND OF THE INVENTION

The invention relates to the attachment of a drying rack to a wall and, in particular, to folding drying racks that are composed of frames made of metal wire or tubing, have drying rack crosspieces, are articulated, are associated with means for securing in the utilization position, and are provided with hooks for fastening to a radiator or a bar.

It is known that various types of drying racks can be used to dry washing, some of which have to be attached to at least one wall of the dwelling, while others are displaceable, folding, and mounted on feet, or can be hooked to a radiator.

Fixed drying racks require mounting holes to be made in the walls, something which not everyone is able to do, harms the wall, and engenders penalties when the tenant leaves his dwelling.

Drying racks that attach to radiators have the advantage of not harming the premises but the disadvantage of being attachable only to areas of the dwelling that have radiators. Thus, they can only be used as a supplement to a drying rack or solely for small garments.

SUMMARY OF THE INVENTION

A goal of the present invention is to remedy these drawbacks by providing a device for attaching a drying rack provided with hanging hooks that requires no mounting holes and allows the drying rack to be disposed against any smooth wall such as a tiled wall or window.

The attaching device according to the invention includes a levered suction cup whose body, in the shape of a circular dome, has an extension parallel to one diameter and a plane end face substantially perpendicular to the surface against which the suction cup is applied. The attaching device also includes a transverse, rectilinear mounting bar with a plane central supporting surface that abuts the end face of the extension of the body and a mounting means for attaching the bar to the extension of the suction cup body.

This device can be attached to any smooth surface, particularly in a bathroom, and thus enables any drying rack with hooks to be attached by its crossbar. After use, the drying rack can be removed and even folded down and the mounting device can be either removed or left in place in view of its small size.

By using a large number of mounting devices and hence drying racks, it is possible to have a long drying length of in a small space, for example over a bathtub which collects the drips.

The device is very easily mounted on any wall simply by manipulating the lever of the suction cup, something that anyone can do and does not damage the receiving wall.

Other characteristics will emerge from the description which refers to the attached drawings.

BRIEF DESCRIPTION OF THE DRAWINGS

Embodiments of this invention will be described in detail, with reference to the following drawings, wherein like numerals represent like elements and wherein.

DETAILED DESCRIPTION OF PREFERRED EMBODIMENTS

Figure 1:
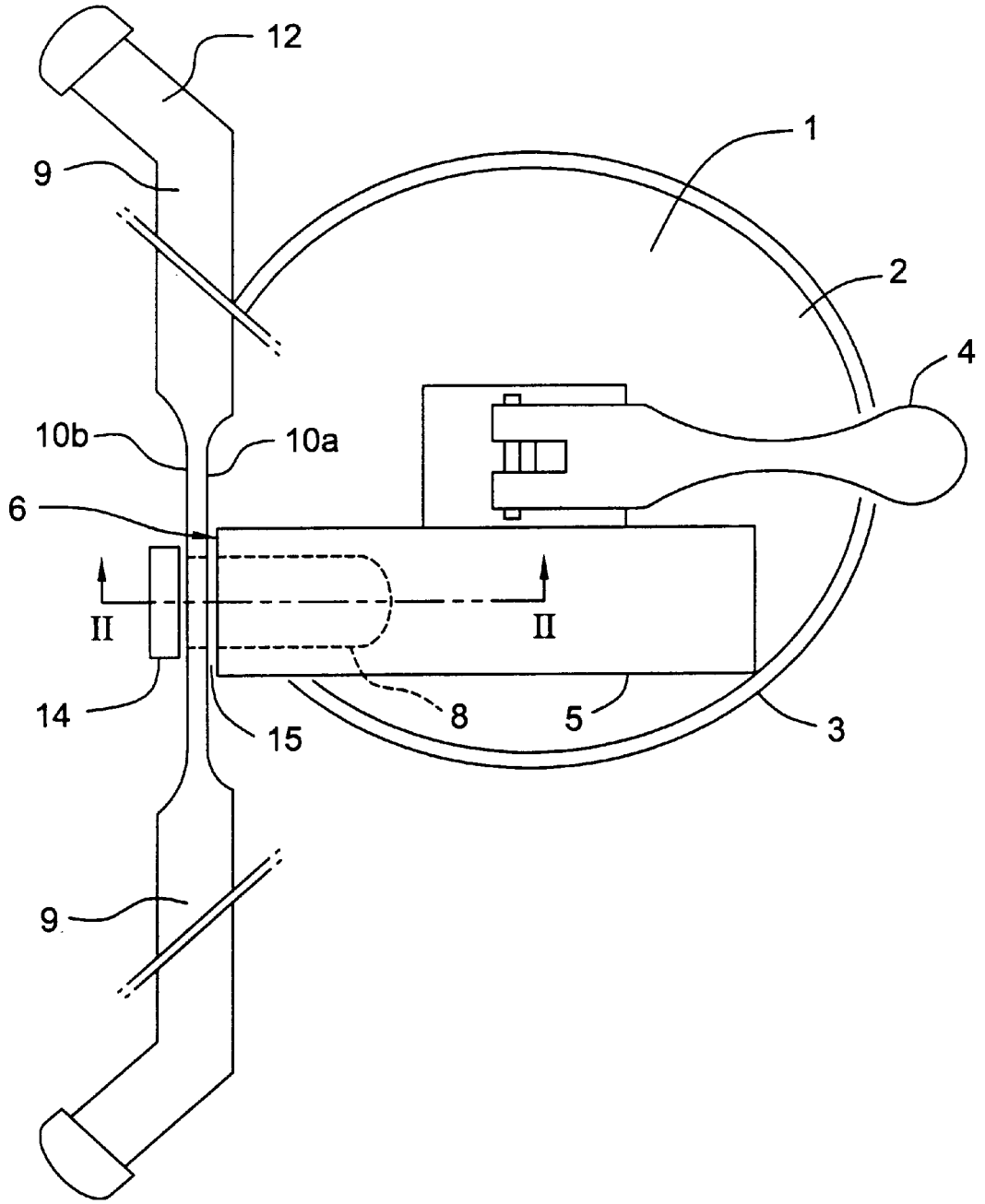
FIG. 1 is a front elevation of one embodiment of the mounting device.

In these drawings, numeral 2 refers to the body, in the shape of a circular dome, of a suction cup 1 also having a disk-shaped elastically deformable membrane 3. This membrane is joined at its center to a shaft, not shown, movable by an articulated lever 4. The body 2 is integral with an extension 5 which, in the embodiment shown, is offset relative to the diametral plane of the body and to its lengthwise axis which is parallel to one diameter. This extension is provided with an end face 6 which is substantially perpendicular to the surface to which the suction cup is to be applied. From the end face 6 emerges a threaded bore 7 comprised, for example, of the inside part of an insert 8 embedded in the synthetic material of which the body 2 of the suction cup is made.

The device according to the invention also has a mounting bar 9 which is rectilinear and extends transversely on both sides of extension 5 and is substantially parallel to the wall to which the suction cup is attached.

In the embodiment shown, the central part of the bar 9 is provided with two plane central supporting surfaces comprised of two flats 10*a*, 10*b* shaped by local flattening of the tube of which the bar is made. This central part is traversed by a smooth bore 11 which can be seen in FIG. 2.

At each of its ends, the bar is provided with an upwardly bent arm 12 which forms a stop for the hooks of the drying rack. Its length is adapted to the space between hooks 13 of a drying rack of the type shown in FIG. 3, this length in general being between 30 and 50 centimeters.

In the embodiment shown in FIG. 1, the bar 9 is attached to the body 2 of the suction cup by a screw 14 whose shank passes through the bore 11 of the bar and the bore of a washer 15, and screws into the threaded bore 7 of the body 2, while the head rests on the upper flat 10*b*provided on the central part of the bar.

Figure 2:
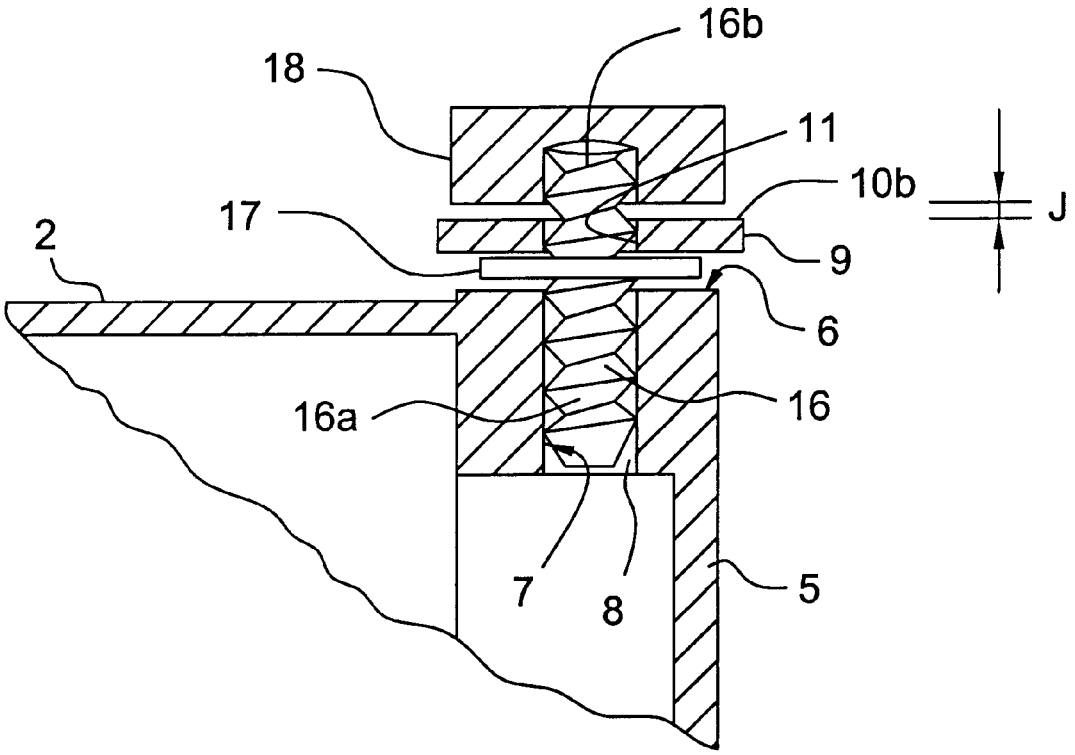
FIG. 2 is a partial side view along line II—II in FIG. 1 showing one embodiment of the means of attaching the crossbar to the suction cup body.

In the embodiment shown in FIG. 2, a lower threaded part 16*a* of a threaded stud 16 with a collar 17 is screwed into the threaded bore 7 of the extension 5 until the collar 17 abuts the end face 6 of this extension, while the upper threaded part 16*b* of the stud passes freely through the bore 11 of the bar 9 to receive a threaded knob 18. When this threaded knob is completed screwed onto the stud, there is axial play J between the knob and the flat LO*b* of the bar 9. This play, greatly exaggerated in FIG. 2, allows the bar 9 to be displaced angularly relative to body 2 of the suction cup, for example to adjust the position of this bar to the configuration of the wall.

Figure 3:
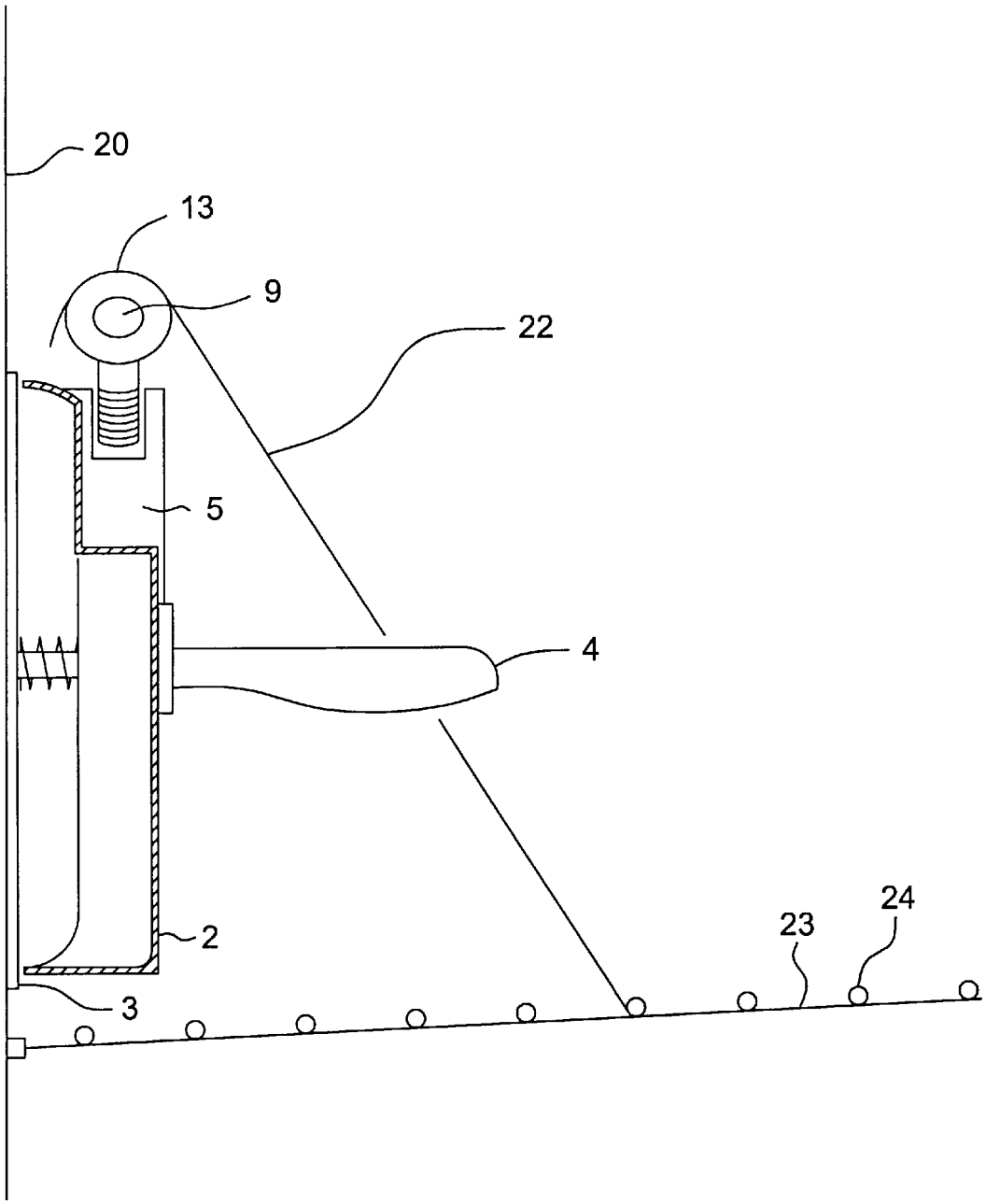
FIG. 3 is a side elevation with a partial cross section, showing the device when a hook-type drying rack is used.

As shown in FIG. 3, when the device according to the invention is attached to a wall 20, the bar 9 is disposed substantially horizontally. On its parts disposed on either side of body 2 of the suction cup, it can thus receive hooks 13 of a drying rack 22 that has at least one metal frame 23 with crosspieces 24.

When the drying rack is no longer in use, it can be folded down, thus leaving more space in its location. The mounting device can also be removed, but because it is small it can be left in place.

The mounting device according to the invention can be used on any smooth wall such as the tiled or glass walls of a bathroom, a toilet, or other rooms without its installation or removal causing any damage.

Finally, a given mounting device can be used with various types of drying racks because they have hooks designed to adapt to various types of radiators.

While this invention has been described with specific embodiments thereof, it is evident that many alternatives, modifications, and variations will be apparent to those skilled in the art. Accordingly, the preferred embodiments of the invention as set forth herein are intended to be illustrative, not limiting. Various changes may be made without departing from the spirit and scope of the invention.

What is claimed is:

1. A device for mounting a drying rack provided with hanging hooks, the device comprising:

a levered suction cup having a body in a shape of a circular dome, the body having an extension parallel to a diameter thereof and a plane end face adapted to be substantially perpendicular to a surface against which the suction cup is applied;

a transverse, rectilinear mounting bar with a plane supporting surface centrally located along a longitudinal length of the mounting bar that abuts the plane end face of the extension of the suction cup body; and mounting means for attaching the mounting bar to the plane end face of the extension of the suction cup body.

2. The device according to claim 1, wherein the mounting bar includes a tube having a central part centrally located along a longitudinal length of the mounting bar, wherein the central part comprises two oppositely disposed flat surfaces traversed by a bore for passage of the mounting means, the plane supporting surface comprising one of the two oppositely disposed flat surfaces.

3. The device according to claim 2, wherein the mounting bar has, at each end thereof, bent arms configured to extend upwardly when the suction cup is applied to a surface so as to form stops for the hanging hooks.

4. The device according to claim 3, wherein the extension of the suction cup body is provided with a threaded bore emerging from the plane end face, and the mounting means includes a screw having a shank passing through a bore of the mounting bar and an intermediate washer and screwing into the extension of the suction cup body, while a head of the screw abuts the mounting bar.

5. The device according to claim 3, wherein the extension of the suction cup body is provided with a threaded bore emerging from the plane end face, and the mounting means includes a threaded stud with a collar, one end of the stud screwing into the threaded bore until the collar abuts the plane end face, and another end of the threaded stud receiving a threaded knob which, when completely screwed on, provides axial play between the knob and the mounting bar to allow for angular movements of the mounting bar.

6. The device according to claim 2, wherein the extension of the suction cup body is provided with a threaded bore emerging from the plane end face, and the mounting means includes a screw having a shank passing through a bore of the mounting bar and an intermediate washer and screwing into the extension of the suction cup body, while a head of the screw abuts the mounting bar.

7. The device according to claim 2, wherein the extension of the suction cup body is provided with a threaded bore emerging from the plane end face, and the mounting means includes a threaded stud with a collar, one end of the stud screwing into the threaded bore until the collar abuts the plane end face, and another end of the threaded stud receiving a threaded knob which, when completely screwed on, provides axial play between the knob and the mounting bar to allow for angular movements of the mounting bar.

8. The device according to claim 1, wherein the mounting bar has, at each end thereof, bent arms configured to extend upwardly when the suction cup is applied to a surface so as to form stops for the hanging hooks.

9. The device according to claim 8, wherein the extension of the suction cup body is provided with a threaded bore emerging from the plane end face, and the mounting means includes a screw having a shank passing through a bore of the mounting bar and an intermediate washer and screwing into the extension of the suction cup body, while a head of the screw abuts the mounting bar.

10. The device according to claim 8, wherein the extension of the suction cup body is provided with a threaded bore emerging from the plane end face, and the mounting means includes a threaded stud with a collar, one end of the stud screwing into the threaded bore until the collar abuts the plane end face, and another end of the threaded stud receiving a threaded knob which, when completely screwed on, provides axial play between the knob and the mounting bar to allow for angular movements of the mounting bar.

11. The device according to claim 1, wherein the extension of the suction cup body is provided with a threaded bore emerging from the plane end face, and the mounting means includes a screw having a shank passing through a bore of the mounting bar and an intermediate washer and screwing into the extension of the suction cup body, while a head of the screw abuts the mounting bar.

12. The device according to claim 1, wherein the extension of the suction cup body is provided with a threaded bore emerging from the plane end face, and the mounting means includes a threaded stud with a collar, one end of the stud screwing into the threaded bore until the collar abuts the plane end face, and another end of the threaded stud receiving a threaded knob which, when completely screwed on, provides axial play between the knob and the mounting bar to allow for angular movements of the mounting bar.

* * * * *